United States Patent [19]

Donahue et al.

[11] Patent Number: 4,875,517

[45] Date of Patent: Oct. 24, 1989

[54] METHOD OF PRODUCING SALT CORES FOR USE IN DIE CASTING

[75] Inventors: Raymond J. Donahue, Fond du Lac; Terrance M. Cleary, Allenton; Frederick M. Hauenstein, Oshkosh; Daniel H. Marcellis, Appleton, all of Wis.

[73] Assignee: Brunswick Corporation, Skokie, Ill.

[21] Appl. No.: 346,164

[22] Filed: May 1, 1989

[51] Int. Cl.[4] ..... B22C 9/10; B22D 29/00

[52] U.S. Cl. ..... 164/34; 164/132; 164/522

[58] Field of Search ..... 164/132, 34, 35, 36, 164/522, 369

[56] References Cited

U.S. PATENT DOCUMENTS 3,311,956 4/1967 Townsend et al. ..... 164/132 X
3,459,253 8/1969 Woolcott ..... 164/132 X

FOREIGN PATENT DOCUMENTS 48-17570 5/1973 Japan ..... 164/34
60-3958 1/1985 Japan ..... 164/132

*Primary Examiner*—Nicholas P. Godici
*Assistant Examiner*—J. Reed Batten, Jr.
*Attorney, Agent, or Firm*—Andrus, Sceales, Starke & Sawall

[57] ABSTRACT

A pattern, identically proportional in configuration to the salt core to be produced, is initially formed from an evaporable foam material. The evaporable foam pattern is positioned in a mold and surrounded with an unbonded flowable material, such as sand. The pattern is contacted with a molten salt and the high temperature of the salt will vaporize the pattern, with the vapor being captured within the interstices of the sand while the molten salt will fill the void created by vaporization of the foam to provide a salt core identical in configuration to the pattern. The salt core is subsequently used in a high pressure die casting operation to cast a metal part.

12 Claims, No Drawings

METHOD OF PRODUCING SALT CORES FOR USE IN DIE CASTING

BACKGROUND OF THE INVENTION

In high pressure die casting, the complexity of a part is limited generally to straight pull cores with 1° draft. Exceptions to this generalization are collapsible metal cores, "loose pieces" (which are constrained metal pieces which are not normally retractable, such as the pinion gear cavity of a gearcase), and high integrity expandable cores. When it is practical to use collapsible cores or loose pieces to achieve the desired shape in the casting, this is most economical. When the desired shape becomes very complex, such as the air/fuel mixture ports of a two-cycle engine, the use of loose pieces or retractable cores are not practical, hence the need for high integrity expendable cores.

The core required in high pressure die casting must be able to withstand a metallostatic pressure of 20,000 psi, dynamic forces resulting from a metal front advancing at 60 in/sec and metal temperature of 1200° F. After this has been achieved and the metal casting has been made with the expendable core, the expendable core has to be removed from the casting.

The most widely used expendable, high integrity core used in high pressure die casting is a fused salt core. It can withstand the dynamic and static forces of the die casting process, the temperature of the metal and yet is easly removed by dissolving the core with water. It has been the general practice to make this core by a die casting process with certain inherent limitations which include:

1. The strinkage of the salt upon cooling is significantly greater than the shrinkage of the metal die. This leads to cracking of the core.

2. Often the process is limited to having isolated heavy sections due to the nature of the die casting process. This leads to shrinkage cavities which may later collapse during the die casting of the metal around the expendable core.

Therefore, there has been a need to improve upon the process for making salt cores.

SUMMARY OF THE INVENTION

The invention is directed to a method of producing salt cores for use in high pressure die casting operations. In accordance with the invention, an evaporable foam pattern formed of a material, such as polystyrene, is formed with a shape identically proportional to that of the salt core to be produced. The evaporable foam pattern is placed in a mold and surrounded with an unbonded flowable material, such as sand. Molten salt, such as sodium chloride, at a temperature in the range of about 1250° F. to 1400° F. is then introduced into the mold via a sprue and into contact with the evaporable foam pattern. The heat of the molten salt vaporizes the pattern with the vapor being discharged into the interstices of the sand, while the molten salt fills the void created by vaporization of the pattern, to produce a salt core identical in configuration to the evaporable foam pattern.

The salt core thus produced is used in a high pressure die casting operation for casting a metal part. The salt core is spaced from the walls of the die to provide a die cavity and a molten metal, such as an aluminum alloy, having a melting point less than the melting point of the salt core, is introduced into the die cavity and on solidifying provides a cast metal part. The cast part is then removed from the die and the salt core is removed from the cast part by washing the part in a solvent, such as water, which will dissolve the salt core.

The use of the evaporable foam pattern to produce the salt core is substantially less expensive than prior processes, in which the salt cores were die cast, thus requiring a substantial capital outlay for the steel dies and die casting equipment.

As a further and important advantage, the use of the evaporable foam pattern enables the salt cores to be formed in complex configurations that were not possible when using die casting techniques to form the salt cores. For example, when casting a salt core having internal cavities with the process of the invention, the radially inward shrinkage of the salt toward the internal cavity will be cushioned by the unbonded sand in the cavity, thus providing a degree of collapsibility to accommodate the high shrinkage of the salt without hot tearing or cracking.

As a further advantage, the use of the evaporable foam pattern provides a salt core which is dimensionally precise.

Other objects and advantages will appear in the course of the following description.

DESCRIPTION OF HTE ILLUSTRATED EMBODIMENT

The invention relates to the die casting of metal parts using salt cores produced by an evaporable foam process. The metal part to be produced can be an aluminum alloy engine block, such as a V-6 engine. In die casting the engine block, salt cores are used to produce the cylinder cavities. However, it is contemplated that the salt cores produced by the invention can be used to produce a wide variety of metal products, such as aluminum alloy or zinc alloy products, in high pressure die casting operations.

In accordance with the method of the invention, an evaporable foam pattern is initially produced having a contour identically proportional to the salt core to be produced. The evaporable foam material is a foamed polymeric material, such as polystyrene or polymethylacrylate. The evaporable foam pattern can be formed of one or more parts which are glued together along mating surfaces or parting lines.

The evaporable foam pattern can be coated with a porous ceramic material by immersing the pattern in a tank of ceramic wash, so that the wash will contact both the internal and external surfaces of the pattern. Excess wash is then drained from the pattern and the wash is dried to provide the porous ceramic coating on both the internal and external surfaces of the pattern.

The evaporable foam pattern is then placed in a mold and an unbonded flowable material, such as sand, is introduced into the mold and surrounds the pattern, as well as filling the internal cavities of the pattern. An evaporable foam sprue connects the pattern with the exterior of the mold and a molten salt is then fed through the sprue to the pattern. The heat of the molten salt, which is at a temperature above 1250° F. and generally in the range of 1250° F. to 1400° F., will vaporize the foam material with the vapor being trapped within the interstices of the sand, while the molten salt will fill the void created by vaporization of the pattern to produce a salt core, which is identical in configuration to the evaporable foam pattern.

The salt to be employed should generally have a melting point higher than the metal to be used in casting the metal part and the salt should be soluble in a solvent which will not attack the cast metal. For most applications, sodium chloride is preferred as the salt, because it is inexpensive, readily available and can be solubilized from the metal part by water.

After the salt core has solidified, it is removed form themold and is used in a die casting operation to produce the metal part. In this regard, the salt core is positioned in a die, preferably formed of steel, and is spaced from the external die surfaces to provide a die cavity. A molten metal, such as an aluminum alloy is then introduced inot the die cavity and on solidification of the metal, a cast metal part is produced.

The moltenmetal is introduced into the die under high pressure which may generally be in the range of about 5,000 psi to 20,000 psi and generally about 10,000 psi.

After solidification of the molten metal, the cast metal part is removed from the die and the salt core is washed from the metal part. When using a salt core formed of a material such as sodium chloride, the core is preferably removed by immersing the metal part in a wash tank containing water at roomtemperature. The water is agitated and depending upon the volume of the salt core, it will normally be completely dissolved in the wash solution in a period of 5 to 30 minutes.

The invention eliminates the need for using expensive steel dies for producing the salt cores, thereby substantially reducing the overall cost of the metal part to be produced.

As a further and substantial advantage, the use ofthe evaporable foam pattern enables the salt core to be formed with more complex configurations than salt cores produced by diecasting. When casting the salt core using the evaporable foam pattern, the sand, which is contained within the internal cavities of the pattern, will tend to collapse and accommodate inward shrinkage of the salt, as opposed to an unyielding steel die. The collapsibility of the unbonded sand will thus prevent hot tearing of the salt core during solidication. Thus, the use of the evaporable foam pattern enables the salt cores to be produced in larger and more complicated configurations while maintaining the structural integrity of the core.

Various modes of carrying out the invention are contemplated as being within the scope of the following claims particularly pointing out and distinctly claiming the subject matter which is regarded as the invention.

We claim:

1. A method of producing a salt core for high pressure die casting, comprising the steps of preparing a pattern of an evaporable foam material having a configuration identically proportional to the salt core to be produced, positioning the pattern in a mold and surrounding the pattern with an unbonded flowable inert finely divided material, contacting the pattern with a molten salt to vaporize the pattern with the vapor being trapped within the interstices of the flowable material and said molten salt filling the void created by vaporization of the pattern to produce a salt core having a configuration identically proportional to said pattern, and removing the salt core from the mold.

2. The method of claim 1, wherein said flowable material is sand.

3. The method of claim 1, wherein said evaporable foam material is selected from the group consisting of polystyrene and polymethylmethacrylate.

4. The method of claim 1, wherein said salt is soluble in a liquid solvent.

5. The method of claim 4, wherein said salt is water soluble.

6. A method of producing a cast metal part, comprising the steps of preparing a pattern of an evaporable foam pattern havinga configuration identically proportional to a salt core to be produce,d positioning the pattern in a mold and surrounding the pattern with a flowable unbonded inert finelydivided material, contacting the pattern with molten salt to vaporize the pattern, with the vapor being trapped in the interstices of the flowable material and the salt filling the void created by vaporization ofthe pattern to provide a solidified salt core having a configuration identically proportional to said pattern, positioning the salt core in a metal die with the core spaced from the die to provide a die cavity, introducing a molten metal having a melting point less than the melting point of said salt core into the die cavity to provide a cast metal part, and dissolving the salt core from the cast metal part.

7. The method of claim 6, wherein said die is formed of steel and said molten metal is aluminum.

8. The method of claim 6, wherein said salt has a melting point greater than 1200° F.

9. The method of claim 6, wherein said salt is sodium chloride and said step of dissolving said salt core comprises contacting said salt core with water.

10. A method of producing a cast metal part, comprising the steps of preparing a pattern of an evaporable foam polymeric material, positioning the pattern in a mold and surrounding the pattern with unbonded sand, contacting the pattern with molten sodium chloride to vaporize the pattern with vapor being trapped within the interstices of the sand and the molten sodium chloride filling the void created by vaporization of the pattern to provide a solidifed salt core identically proportional in configuration to said pattern, removing the salt core from the mold, positioning the salt core in a die with the core spaced from the die to provide a die cavity therebetween, introducing a molten metal having a melting point less than sodium chloride into the die cavity and solidifying the molten metal to provide a cast metal part, removing the cast metal part from the die, and contacting the salt core with water to dissolve the salt core from said cast metal part.

11. The method of claim 10, wherein said polymeric material is selected from the group consisting of polystyrene and polymethylmethacrylate.

12. The method of claim 10, wherein said die is formed of steel and said molten metal is selected from the group consisting of aluminum and zinc alloys.

* * * * *

UNITED STATES PATENT AND TRADEMARK OFFICE

CERTIFICATE OF CORRECTION

PATENT NO. : 4,875,517

DATED : October 24, 1989

INVENTOR(S) : RAYMOND J. DONAHUE ET AL

It is certified that error appears in the above-identified patent and that said Letters Patent is hereby corrected as shown below:

Col. 4, Line 15, CLAIM 6, Delete "havinga" and substitute therefor ---having a---; Col. 4, Line 16, CLAIM 6, Delete "produce,d" and substitute therefor ---produced---; Col. 4, Line 18, CLAIM 6, Delete :finelydivided" and substitute therefor ---finely divided---; Col. 4, Line 22, CLAIM 6, Delete "ofthe" and substitute therefor ---of the---

Signed and Sealed this

Thirtieth Day of July, 1991

*Attest:*

*Attesting Officer*

HARRY F. MANBECK, JR.

*Commissioner of Patents and Trademarks*